US011859830B2

(12) United States Patent
Paller

(10) Patent No.: US 11,859,830 B2
(45) Date of Patent: Jan. 2, 2024

(54) OVEN GAS BURNER SHUTTER WITH DUCTED INLET

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 423 days.

(21) Appl. No.: 17/098,922

(22) Filed: Nov. 16, 2020

(65) Prior Publication Data

US 2022/0154936 A1 May 19, 2022

(51) Int. Cl.

| | |
|---|---|
| ***F24C 3/08*** | (2006.01) |
| ***F23L 3/00*** | (2006.01) |
| ***F23L 1/00*** | (2006.01) |

(52) U.S. Cl.

CPC ..... *F24C 3/087* (2013.01); *F23L 1/00* (2013.01); *F23L 3/00* (2013.01)

(58) Field of Classification Search

CPC ..... F24C 3/087; F23L 1/00; F23L 3/00

USPC ..... 126/41 R

See application file for complete search history.

(56) References Cited

U.S. PATENT DOCUMENTS

| | | | | |
|---|---|---|---|---|
| 3,259,170 | A * | 7/1966 | Koehrer | F23D 14/04 239/416.5 |
| 3,289,730 | A * | 12/1966 | Elmy | F23D 14/84 239/523 |
| 3,436,166 | A * | 4/1969 | Erickson | F23D 14/64 251/145 |
| 4,346,845 | A | 8/1982 | Meyerhoff et al. | |
| 4,416,249 | A * | 11/1983 | Reynolds | A47J 37/06 126/41 R |
| 4,715,356 | A | 12/1987 | Reynolds | |
| 4,794,907 | A * | 1/1989 | Corliss | F23K 5/005 126/39 R |
| 4,846,143 | A | 7/1989 | Csadenyi | |
| 5,553,603 | A * | 9/1996 | Barudi | F23D 14/60 126/92 R |
| 5,931,661 | A * | 8/1999 | Kingery | F23D 14/64 431/354 |
| 7,506,645 | B2 | 3/2009 | Offredi | |
| 11,246,451 | B2 * | 2/2022 | Alden | F23D 14/84 |
| 2019/0264909 | A1 | 8/2019 | Voss et al. | |

FOREIGN PATENT DOCUMENTS

| | | |
|---|---|---|
| WO | 2002/235904 | 8/2002 |

* cited by examiner

*Primary Examiner* — Avinash A Savani
(74) *Attorney, Agent, or Firm* — Dority & Manning, P.A.

(57) ABSTRACT

A burner assembly for an oven appliance, the oven appliance defining a vertical direction, a lateral direction, and a transverse direction and including a cooking chamber, the burner assembly including a gas burner provided in the cooking chamber, the gas burner defining a clean air port, and a shutter housing attached to a first end of the gas burner, the shutter housing defining an air inlet in fluid communication with the clean air port, and wherein the air inlet is positioned below the clean air port along the vertical direction.

16 Claims, 5 Drawing Sheets

OVEN GAS BURNER SHUTTER WITH DUCTED INLET

FIELD OF THE INVENTION

The present subject matter relates generally to oven appliances, and more particularly to gas burners in oven appliances.

BACKGROUND OF THE INVENTION

Generally, oven appliances may include one or more heat sources to provide different styles of heating to a cooking chamber (e.g., baking, broiling, roasting, etc.). A first heat source may be provided at a bottom of the cooking chamber while a second heat source may be provided at a top of the cooking chamber. At least one of these heat sources may be a gas heat source. The gas heat source generally requires a mixture of fuel and clean air in order to efficiently generate heat to heat the cooking chamber. Typically, the air supplied to the gas heat source is supplied from the cooking chamber itself.

However, problems exist in conventional oven appliances. For example, current air supply systems are inefficient in supplying clean air to the gas heat source. In detail, exhaust products from the gas heat source itself may be resupplied to the gas heat source along with clean air, resulting in a decrease in burning efficiency and heat production. For example, hot exhaust gases from one or more heat sources within the cooking chamber tend to collect at the top of the cooking chamber. As such, when the gas heat source is provided at or near the top of the cooking chamber, the hot exhaust gases may be supplied to the gas heat source. Further, conventional gas heat sources include complex and oversized constructions to access clean air.

Accordingly, an oven appliance that obviates one or more of the above-mentioned drawbacks would be beneficial. In particular, a gas heat source providing easy access to clean air would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a burner assembly for an oven appliance is provided. The oven appliance may define a vertical direction, a lateral direction, and a transverse direction and include a cooking chamber. The burner assembly may include a gas burner provided in the cooking chamber, the gas burner defining a clean air port, and a shutter housing attached to a first end of the gas burner, the shutter housing defining an air inlet in fluid communication with the clean air port. The air inlet may be positioned below the clean air port along the vertical direction.

In another exemplary aspect of the present disclosure, an oven appliance defining a vertical direction is disclosed. The oven appliance may include a cabinet defining a cooking chamber therein, a gas burner mounted within the cooking chamber, the gas burner defining a clean air port, and a shutter housing connected to the gas burner. The shutter housing may include a first shutter housing, and a second shutter housing slidably connected to the first shutter housing. The first shutter housing and the second shutter housing may collectively define an air inlet through which air is delivered to the gas burner via the clean air port.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
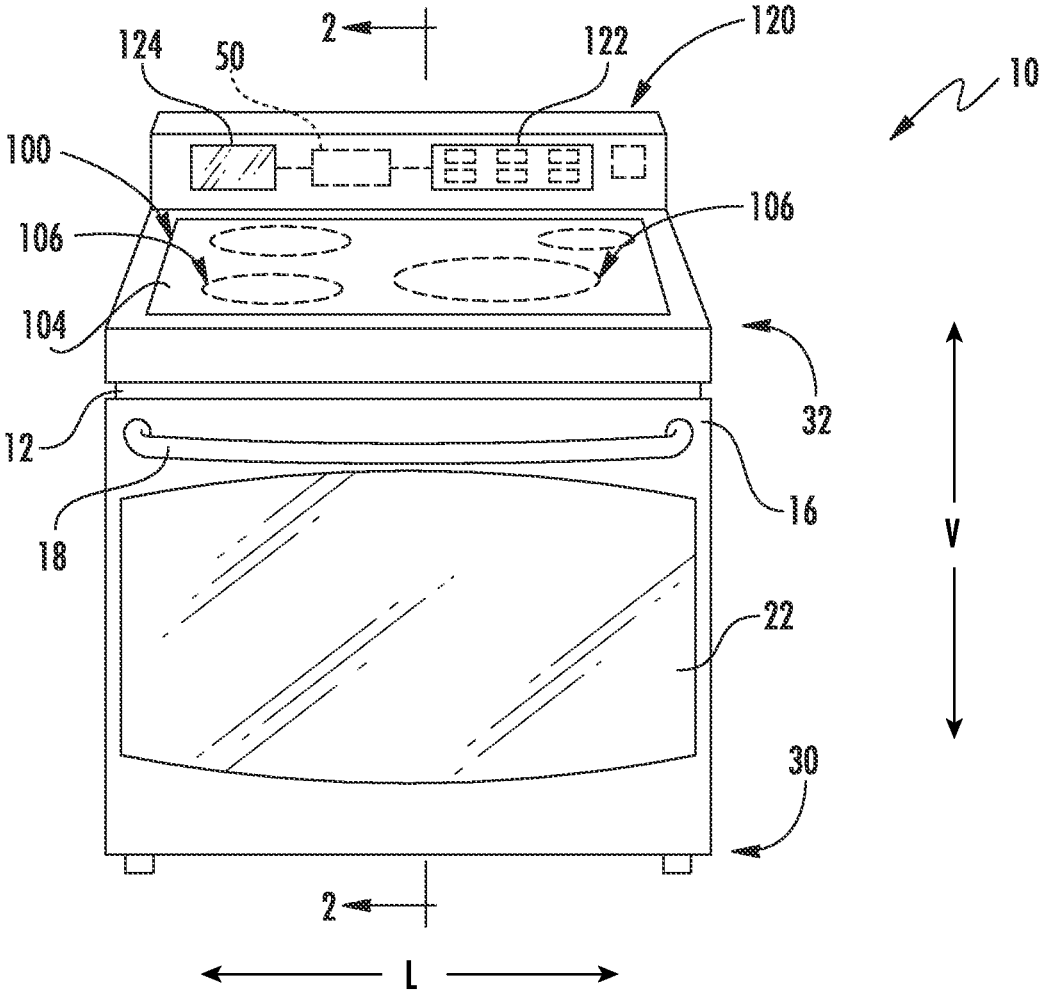
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
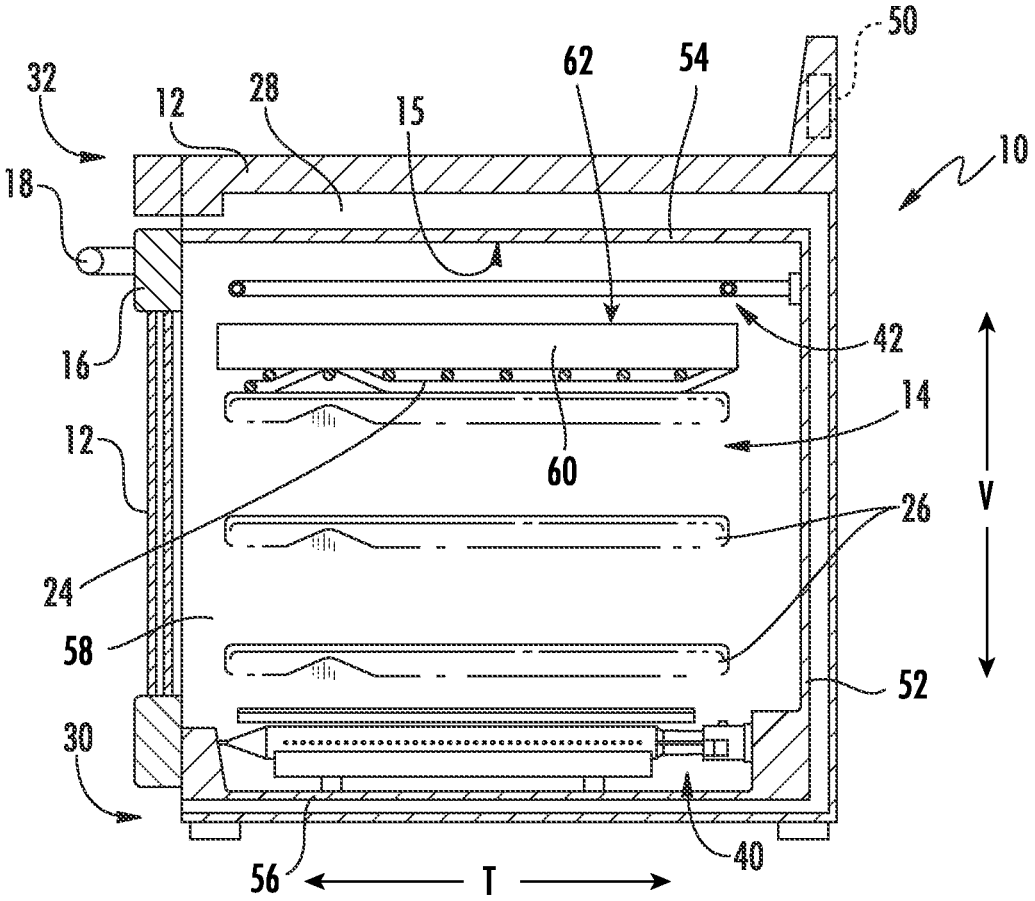
FIG. 2 provides a section view of the exemplary oven appliance of FIG. 1, taken along the line 2-2.
Figure 3:
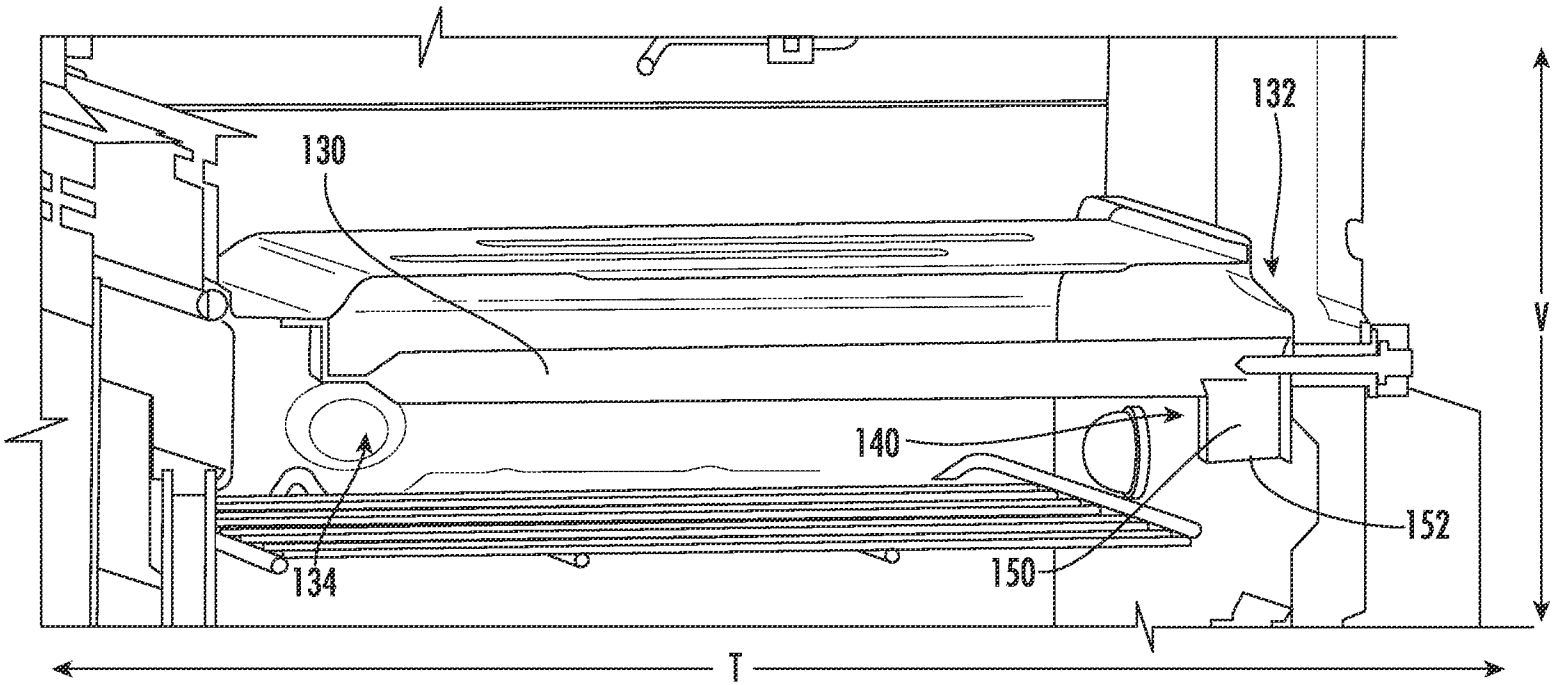
FIG. 3 provides a side perspective, partial cut-away view of a portion of the exemplary oven appliance of FIG. 1 including a gas heat source.

FIG. 1 provides a perspective view of an oven appliance 10 according to an exemplary embodiment of the present disclosure. FIG. 2 provides a section view of oven appliance 10 taken along the 2-2 line of FIG. 1. FIG. 3 provides a schematic, side, section view of a portion of oven appliance 10. As may be seen, oven appliance 10 defines a vertical direction V, a lateral direction L and a transverse direction T. The vertical direction V, the lateral direction L and the transverse direction T are mutually perpendicular and form an orthogonal direction system.

Oven appliance 10 is provided by way of example only and is not intended to limit the present subject matter in any aspect. Other oven or range appliances having different configurations, different appearances, or different features may also be utilized with the present subject matter as well (e.g., double ovens, electric cooktop ovens, stand-alone ovens, etc.).

Thus, the present subject matter may be used with other oven appliance configurations (e.g., that define one or more interior cavities for the receipt of food or having different pan or rack arrangements than what is shown in FIG. 2). Further, the present subject matter may be used in a stand-alone cooktop, range appliance, or any other suitable appliance.

Oven appliance 10 generally includes a cooking assembly. In particular, the cooking assembly may include one or more heating elements. For example, in some embodiments, the cooking assembly, and thus the oven appliance 10 includes an insulated cabinet 12 with an interior cooking chamber 14 defined by an interior surface 15 of cabinet 12. Cooking chamber 14 is configured for the receipt of one or more food items to be cooked. As shown, chamber 14 is generally defined by a back wall 52, a top wall 54, and a bottom wall 56 spaced from top wall 54 along the vertical direction V by opposing side walls 58 (e.g., a first wall and a second wall).

Oven appliance 10 includes a door 16 rotatably mounted to cabinet 12 (e.g., with a hinge—not shown). A handle 18 may be mounted to door 16 and assists a user with opening and closing door 16 in order to access cooking chamber 14. For example, a user can pull on handle 18 to open or close door 16 and access cooking chamber 14.

In some embodiments, oven appliance 10 includes a seal (not shown) between door 16 and cabinet 12 that assists with maintaining heat and cooking fumes within cooking chamber 14 when door 16 is closed as shown in FIG. 2. Multiple parallel glass panes 22 may provide for viewing the contents of cooking chamber 14 when door 16 is closed and assist with insulating cooking chamber 14. A baking rack 24 is positioned in cooking chamber 14 for the receipt of food items or utensils (e.g., cooking plate 60) that may contain or support food items. Baking rack 24 may be slidably received onto embossed ribs or sliding rails 26 such that rack 24 may be conveniently moved into and out of cooking chamber 14 when door 16 is open.

In some embodiments, baking rack 24 defines a receiving zone on or within which a cooking plate 60 is disposed (e.g., removably mounted or, alternatively, fixedly mounted). Generally, cooking plate 60 may provide a cooking surface 62 on which a food item (e.g., bread or pizza) may be received. Cooking plate 60 may be provided as a solid-nonpermeable member or, alternatively, define one or more apertures through which air may pass. In some embodiments, cooking plate 60 includes or is formed from a heat-retaining material, such as clay, stone (e.g., cordierite), ceramic, aluminum (e.g., aluminum alloy), cast iron, or ceramic-coated carbon steel.

As shown, oven appliance 10 includes one or more heating elements 40, 42 to heat chamber 14 (e.g., as directed by a controller 50 as part of a cooking operation). In certain embodiments, a gas fueled or electric bottom heating element 40 (e.g., a gas burner, a resistive heating element, resistance wire elements, radiant heating element, electric tubular heater or CALROD®, halogen heating element, etc.) is positioned in cabinet 12, for example, at a bottom portion 30 of cabinet 12. Bottom heating element 40 is used to heat cooking chamber 14 for both cooking and cleaning of oven appliance 10. The size and heat output of bottom heating element 40 can be generally configured based on, for example, the size of oven appliance 10.

In additional or alternative embodiments, a top heating element 42 (e.g., a gas burner) is positioned in cooking chamber 14 of cabinet 12, for example, at a top portion 32 of cabinet 12. Top heating element 42 is used to heat cooking chamber 14 for both cooking/broiling and cleaning of oven appliance 10. Like bottom heating element 40, the size, shape, and heat output of top heating element 42 can be configured based on for example, the size of oven appliance 10.

Generally, oven appliance 10 may include a controller 50 in operative communication (e.g., operably coupled via a wired or wireless channel) with one or more other portions of oven appliance 10 (e.g., heating elements 40, 42) via, for example, one or more signal lines or shared communication busses, and signals generated in controller 50 operate oven appliance 10 in response to user input via user inputs 122. Input/Output ("I/O") signals may be routed between controller 50 and various operational components of oven appliance 10 such that operation of oven appliance 10 can be regulated by controller 50. In addition, controller 50 may also be inoperative communication (e.g., wired or, alternatively, wireless communication) with one or more sensors, such as a first temperature sensor or a second temperature sensor. Generally, either or both the first temperature sensor and the second temperature sensor may include or be provided as a thermistor or thermocouple, which may be used to measure temperature at a location within or proximate to chamber 14 and provide such measurements to the controller 50.

Controller 50 is a "processing device" or "controller 50" and may be embodied as described herein. Controller 50 may include a memory and one or more microprocessors, microcontrollers, application-specific integrated circuits (ASICS), CPUs or the like, such as general or special purpose microprocessors operable to execute programming instructions or micro-control code associated with operation of oven appliance 10, and controller 50 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 50 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

As shown in FIG. 2, in optional embodiments, a cooling air flow passageway 28 can be provided within cabinet 12 between cooking chamber 14 and cooktop 100. For example, a portion of passageway 28 may be between cooking chamber 14 and cooktop 100 along a vertical direction V. Passageway 28 is shown schematically in the figures. As will be understood by one of skill in the art using the teachings disclosed herein, cooling air flow passageway 28 may have a variety of configurations other than as shown. Air flowing through passageway 28 can provide convective cooling.

In additional or alternative embodiments, the oven appliance 10 additionally includes a cooktop 100. Cooktop 100 may be disposed on the cabinet 12 such that the total volume of cabinet 12 is generally divided between the cooking chamber 14 and cooktop 100. As shown, cooktop 100 may include a top panel 104. By way of example, top panel 104 may be constructed of glass, ceramics, enameled steel, and combinations thereof. Heating assemblies 106 (e.g., induction heating elements, resistive heating elements, radiant heating elements, or gas burners) may be mounted, for example, on or below the top panel 104. While shown with four heating assemblies 106 in the exemplary embodiment of FIG. 1, cooktop appliance 10 may include any number of heating assemblies 106 in alternative exemplary embodiments. Heating assemblies 106 can also have various diameters. For example, each heating assembly of heating assemblies 106 can have a different diameter, the same diameter, or any suitable combination thereof.

As shown, certain embodiments of oven appliance 10 includes a user interface panel 120, which may be located as shown, within convenient reach of a user of the oven appliance 10. User interface panel 120 is generally a component that allows a user to interact with the oven appliance 10 to, for example, turn various heating elements (such as heating elements 40, 42, 106) on and off, adjust the temperature of the heating elements, set built-in timers, etc. Although user interface panel 120 is shown mounted to a backsplash fixed to cabinet 12, alternative embodiments may provide user interface panel 120 at another suitable location (e.g., on a front portion of cabinet 12 above door 16).

In some embodiments, a user interface panel 120 may include one or more user-interface inputs 122 and a graphical display 124, which may be separate from or integrated with the user-interface inputs 122. The user-interface element 122 may include analog control elements (e.g., knobs, dials, or buttons) or digital control elements, such as a touchscreen comprising a plurality of elements thereon. Various commands for a user to select through the engagement with the user-interface inputs 122 may be displayed (e.g., by touchscreen at the inputs 122 or by the graphical display 124), and detection of the user selecting a specific command may be determined by the controller 50, which is in communication with the user-interface inputs 122, based on electrical signals therefrom. Additionally or alternatively, graphical display 124 may generally deliver certain information to the user, which may be based on user selections and interaction with the inputs 122, such as whether a one or more heating elements 40, 42 within cooking chamber 14 are activated or the temperature at which cooking chamber 14 is set. In certain embodiments, a discrete bake input is included with the inputs 122. User engagement of the bake input may activate the oven appliance 10 or initiate heating within cooking chamber 14 (e.g., such that cooking chamber 14 is directed to a default temperature setting).

Figure 4:
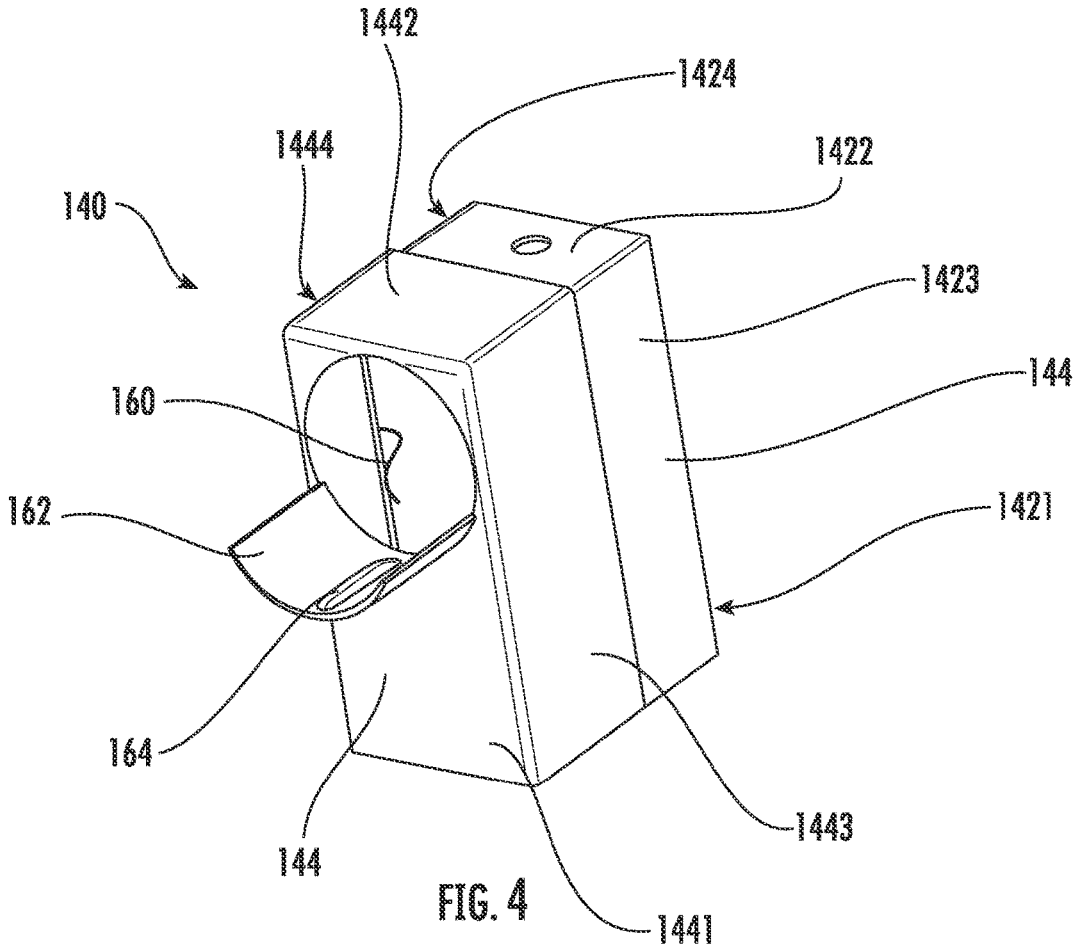
FIG. 4 provides a perspective view of an exemplary shutter assembly.
Figure 5:
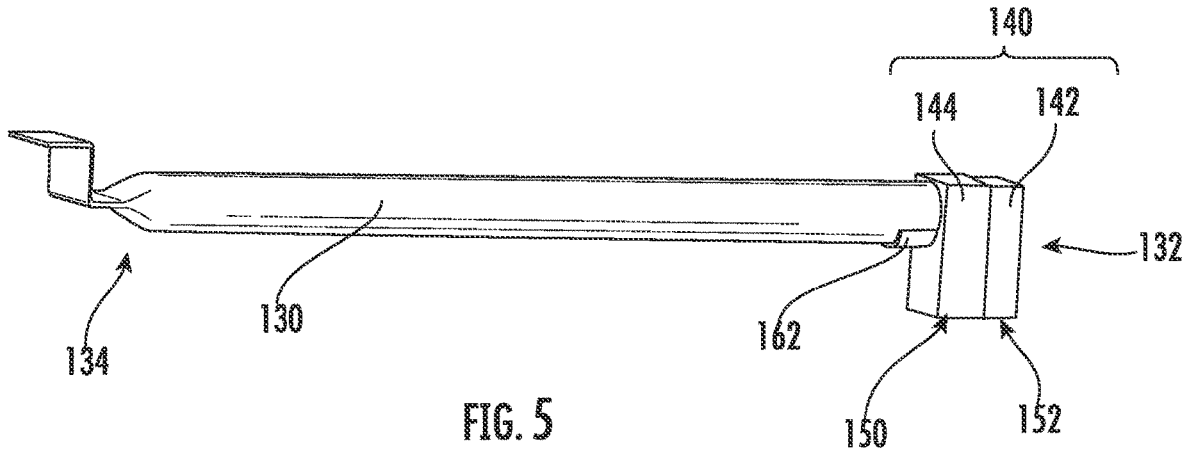
FIG. 5 provides a perspective view of an exemplary gas burner assembly.
Figure 6:
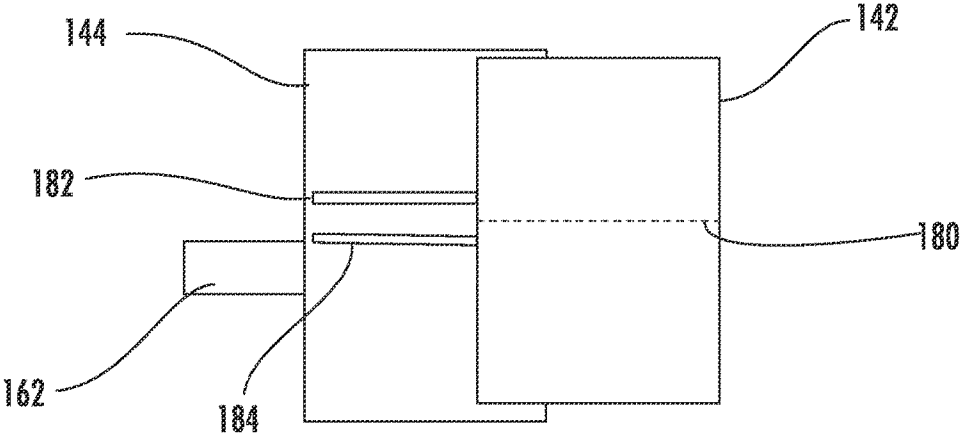
FIG. 6 provides a side cut-away schematic view of the shutter assembly of FIG. 4.
Figure 7:
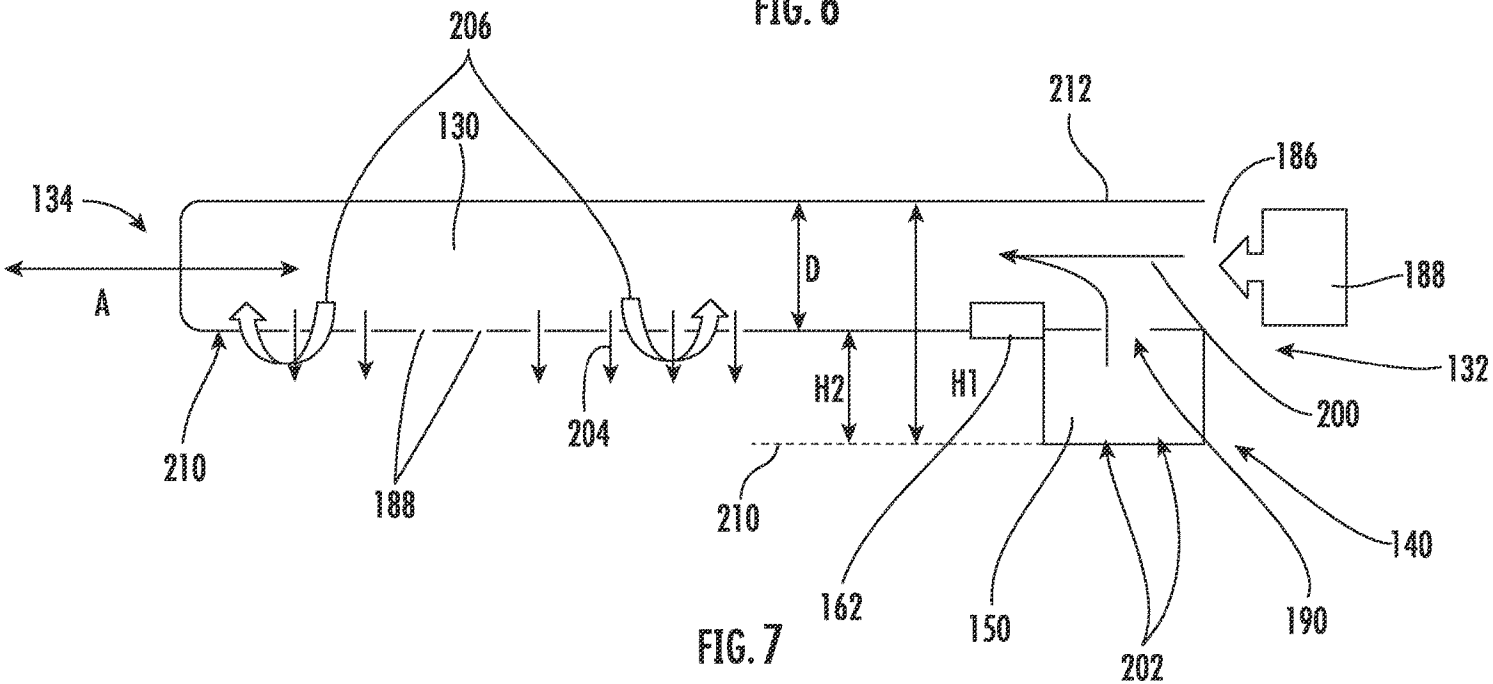
FIG. 7 provides a side cut-away schematic view of the exemplary gas burner assembly of FIG. 5.

FIG. 3 provides a side perspective view of a portion of the exemplary oven appliance of FIG. 1 including a gas heat source. FIG. 4 provides a perspective view of an exemplary shutter assembly. FIG. 5 provides a perspective view of an exemplary gas burner assembly. FIG. 6 provides a side cut-away schematic view of the shutter assembly of FIG. 4. FIG. 7 provides a side cut-away schematic view of the exemplary gas burner assembly of FIG. 5.

Referring primarily to FIGS. 3-7, burner assembly 42 may be a gas burner 130. For example, gas burner 130 may burn a mixture of gas (e.g., supplied from a municipal or outside source) and clean air (e.g., ambient air) to produce heat within interior cooking chamber 14. Gas burner 130 may be orientated in the transverse direction T within interior cooking chamber 14. For example, a first end 132 of gas burner 130 may be located at or near back wall 52 of interior cooking chamber 14, and a second end 134 of gas burner 130 may be located at or near door 16. However, gas burner 130 may be orientated in any suitable direction, such as in the lateral direction L, or to any angle therebetween. First end 132 may be connected to a gas inlet 186. Accordingly, gas from an external source may be selectively supplied to gas burner 130.

Burner assembly 42 may include a shutter housing 140. Shutter housing 140 may be attached to first end 132 of gas burner 130. Shutter housing 140 may facilitate the addition of air (e.g., clean air) into gas burner 130 for combustion. In other words, shutter housing 140 may define a duct 150 through which air is introduced to gas burner 130. Shutter housing 140 may be a single piece having a top end 212 and a bottom end 210 (FIG. 7). For example, bottom end 210 may define an air inlet 152. Additionally or alternatively, a valve may be included at bottom end 210 to adjust an air flow received in air inlet 152. The valve may be any suitable adjustable valve, such as a butterfly valve, a slider plate, or the like. Accordingly, shutter housing 140 may allow for the intake of clean air from cooking chamber 14 to gas burner 130.

In some embodiments, shutter housing 140 includes a first shutter housing 142 and a second shutter housing 144. First shutter housing 142 may be fixed to back wall 52 of cooking chamber 14. Second shutter housing 144 may be slidably attached to first shutter housing 142. In other words, second shutter housing 144 may be configured to move with respect to first shutter housing 142. For example, second shutter housing 144 may be movable in an axial direction A of gas burner 130 (FIG. 7). Accordingly, duct 150 may be defined as a space between first shutter housing 142 and second shutter housing 144. A bottom of shutter housing 140 may be referred to as an air inlet 152. In other words, a periphery of first shutter housing 142 and second shutter housing 144 may define air inlet 152. In some embodiments, air inlet 152 is provided at a bottom of shutter housing 140. Thus, clean air from below gas burner 130 (e.g., in the vertical direction V) may flow into duct 150 via air inlet 152.

According to one embodiment, second shutter housing 144 is attached to first shutter housing 142 in a slidable manner. For example, each of first shutter housing 142 and second shutter housing 144 may include a plurality of rails configured to interact with each other to induce a sliding motion of second shutter housing 144. For instance, as shown in FIG. 6, first shutter housing 142 may include a first rail 180. First rail 180 may extend in the axial direction A of gas burner 130. First rail 180 may be provided on an outer surface of first shutter housing 142. For instance, when second shutter housing 144 interacts with first shutter housing 142, the outer surface of first shutter housing 142 may face an inner surface of second shutter housing 144. In other words, first shutter housing 142 may be accepted within second shutter housing 144. Accordingly, first rail 180 may protrude from the outer surface of first shutter housing 142. For instance, first rail 180 may be provided on an outer surface of top wall 1422, first side wall 1423, second side wall 1424 (which will be explained in detail below), or any combination thereof. Additionally or alternatively, multiple first rails 180 may be provided as required in certain applications.

Second shutter housing 144 may include a top second rail 182 and a bottom second rail 184. Top second rail 182 and bottom second rail 184 may interact with first rail 180 when second shutter housing 144 is attached to first shutter housing 142. In detail, each of top second rail 182 and bottom second rail 184 may extend in the axial direction A of gas burner 130. Top second rail 182 may be spaced apart from bottom second rail 184 in the vertical direction V such that first rail 180 is accepted therebetween. Top second rail 182 and bottom second rail 184 may protrude from the inner surface of second shutter housing 144. For instance, top second rail 182 and bottom second rail 184 may protrude from an inner surface of top wall 1442, first side wall 1443, second side wall 1444 (which will be explained in detail below), or any combination thereof. Additionally or alternatively, multiple top second rails 182 and bottom second rails 184 may be provided as required in certain applications.

Other attachment methods may be used, however, including a pin-and-slot mechanism, a geared mechanism, or a sliding hinge mechanism, for example. Accordingly, a cross-sectional area of duct 150 may be adjustable. For example, second shutter housing 144 may be slid away from first shutter housing 142 in the axial direction of gas burner 130 to enlarge the cross-sectional area of duct 150. Additionally or alternatively, second shutter housing 144 may be slid toward first shutter housing 142 in the axial direction of gas burner 130 to reduce the cross-sectional area of duct 150.

Second shutter housing 144 may include a front wall 1441, a top wall 1442, a first side wall 1443, and a second side wall 1444. A rear portion of second shutter housing 144 (e.g., opposite front wall 1441) may be open. In other words, the rear portion of second shutter housing 144 may be configured to accept first shutter housing 142 therein. Front wall 1441 may have a mounting hole 160 defined therein. Mounting hole 160 may have a shape corresponding to a shape of gas burner 130. For instance, gas burner 130 may have a cylindrical cross-section, and mounting hole 160 may be circular to accept gas burner 130 therein. Accordingly, a diameter of mounting hole 160 may be larger than a diameter of gas burner 130, such that second shutter 144 may slide freely along gas burner 130.

First shutter 142 may include a rear wall 1421, a top wall 1422, a first side wall 1423, and a second side wall 1424. A front portion of first shutter housing 142 (e.g., opposite rear wall 1421) may be open. In other words, the front portion of first shutter housing 142 may be configured to be accepted into second shutter housing 144. In detail, duct 150 may be defined by front wall 1441, first side wall 1443, second side wall 1444, rear wall 1421, first side wall 1423, and second side wall 1424. Rear wall 1421 may further include a gas inlet hole 186 defined therein. For example, the gas inlet hole 186 may provide access to a gas source at a rear of oven appliance 10. In other words, a gas valve 188 may penetrate rear wall 1421 via the gas inlet hole and connect to gas burner 130 to supply gas fuel 200 thereto.

As shown primarily in FIG. 7, gas 200 may be fed to gas burner 130 via a gas valve 188. Gas valve 188 may be connected to gas burner 130 through shutter housing 140 (e.g., through gas inlet hole 186). The gas 200 supplied from gas valve 188 may be combined with clean air 202 supplied from cooking chamber 14. Clean air 202 may enter gas burner 130 through a clean air port 190 via shutter housing 140 (e.g., through duct 150) and mix with gas 200 at first end 132 of gas burner 130. For instance, clean air port 190 may be formed in a bottom 214 of gas burner 130. The mixture of gas 200 and clean air 202 may then proceed through burner 130, to be ignited to produce heat 204. Heat 204 may exit burner 130 through a series of burner holes 188.

Burner holes 188 may be defined through an exterior surface of gas burner 130. For instance, burner holes 188 may be defined through bottom 214 of gas burner 130. However, the location of burner holes 188 is not limited. Additionally or alternatively, the number of burner holes 188 provided is not limited. The combustion of gas 200 and clean air 202 may also product exhaust containing combustion gases 206. Exhaust 206 may collect at or near a top of cooking chamber 14. In other words, exhaust containing combustion gases 206 may drift towards the top of cooking chamber 14 after exiting gas burner 130 via burner holes 188.

Gas burner 130 may have a diameter D. Diameter D of gas burner 130 may vary according to particular applications. In some embodiments, diameter D of gas burner 130 is one inch. Shutter housing 140 may have a height H1. For instance, height H1 of shutter housing 140 may be defined from a bottom 210 of shutter 140 housing to a top 212 of shutter housing 140 in the vertical direction V. In detail, height H1 may be greater than diameter D of gas burner. For example, height H1 may be twice D, three times D, greater than three times D, etc. Height H1 may be sufficient to allow air inlet 152 to reach clean air (i.e., cleaner air than air containing exhaust gas from burner 130). Additionally or alternatively, a distance from the bottom of shutter housing 140 to a bottom of gas burner 130 may be defined as H2.

H2 may be greater than zero. In other words, bottom 210 of shutter housing 140 may be located lower than bottom 214 of gas burner 130 within cooking chamber 14 in the vertical direction V. For example, H2 may be greater than one quarter of D, greater than one half of D, etc. In some embodiments, height H2 may be equal to or greater than D. Height H2 may be sufficient to allow air inlet 152 to reach clean air (i.e., cleaner air than air containing exhaust gas from burner 130). Accordingly, air inlet 152 of duct 150 is provided lower than bottom 214 of gas burner 130 within cooking chamber 14 in the vertical direction V. Advantageously, clean air 202 (i.e., without combustion products) may enter duct 150 via air inlet 152. This is because the exhaust containing combustion products may rise within cooking chamber 14 and collect near the top of cooking chamber 14.

Shutter housing 140 may include a tray 162 extending from a front wall of shutter housing 140 (e.g., front wall 1441 of second shutter housing 144). Tray 162 may have a shape complimentary to a shape of gas burner 130. For instance, referring to the example above, gas burner 130 may have a cylindrical cross-section, and tray 162 may be cylindrical with a concavity corresponding to a curvature of gas burner 130 and facing upward in the vertical direction V. However, a shape of tray 162 may vary according to various applications, and any feasible shape may be used such that gas burner 130 is able to rest upon tray 162.

Tray 162 may have a through hole 164 defined therein. For example, through hole 164 may be defined in the vertical direction V through tray 162. Through hole 164 may aid in locating and assembling gas burner 130 to shutter housing 140. Through hole 164 may be elongated in the transverse direction T. For example, through hole 164 may be a slot having a long axis defined in the transverse direction T. In some embodiments, through hole 164 is a set hole through which a set screw may be fed. For instance, a user may adjust a location of shutter housing 140 along gas burner 130 (e.g., in the axial direction A of gas burner 130) and tighten the set screw against gas burner 130 in order to hold shutter housing 140 in place against gas burner 130.

Advantageously, an air inlet through which air may be introduced to a gas burner (e.g., gas burner 130) may be positioned below the gas burner itself, allowing for more clean air to be introduced to the gas burner while reducing the amount of exhaust gas that is introduced to the gas burner. Additionally or alternatively, incorporating a separate shutter housing (e.g., shutter housing 140), a simpler straight gas burner may be used, eliminating the need for complex curved burner designs, thus reducing costs and improving reliability. Additionally or alternatively, a simple construction of the gas burner and the shutter housing allows for easy manufacture and assembly, reducing the risk of damage due to mis-assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly for an oven appliance, the oven appliance defining a vertical direction, a lateral direction, and a transverse direction and comprising a cooking chamber, the burner assembly comprising:

a gas burner provided in the cooking chamber, the gas burner defining a clean air port, the clean air port being provided along a bottom of the gas burner along the vertical direction; and a shutter housing attached to a first end of the gas burner, the shutter housing defining an air inlet in fluid communication with the clean air port, and wherein the air inlet is positioned below the clean air port along the vertical direction and wherein each of the clean air port and the air inlet is provided below a midpoint of the gas burner along the vertical direction, wherein the shutter housing defines a first shutter housing and a second shutter housing slidably connected to the first shutter housing, and wherein the second shutter housing is configured to slide in the transverse direction axially along the gas burner.

2. The burner assembly of claim 1, wherein the air inlet faces a bottom of the cooking chamber.

3. The burner assembly of claim 1, further comprising a tray extending from the shutter housing in the transverse direction, wherein the gas burner is configured to contact the tray.

4. The burner assembly of claim 1, wherein the shutter housing defines a mounting hole configured to receive the first end of the gas burner.

5. The burner assembly of claim 1, wherein the gas burner is a broil burner mounted at a top of the cooking chamber.

6. An oven appliance defining a vertical direction, comprising:

a cabinet defining a cooking chamber therein;

a gas burner mounted within the cooking chamber, the gas burner defining a clean air port along a bottom of the gas burner; and a rectangular shutter housing connected to the gas burner, wherein the shutter housing defines an air inlet in fluid communication with the clean air port, and wherein the air inlet is positioned below the clean air port along the vertical direction.

7. The oven appliance of claim 6, wherein a height of the rectangular shutter housing in the vertical direction is greater than a diameter of the gas burner.

8. The oven appliance of claim 6, wherein the rectangular shutter housing comprises a first shutter housing and a second shutter housing slidably received within the first shutter housing.

9. An oven appliance defining a vertical direction, comprising:

a cabinet defining a cooking chamber therein;

a gas burner mounted within the cooking chamber, the gas burner defining a clean air port; and a rectangular shutter housing connected to the gas burner, wherein the shutter housing comprises a first rectangular shutter housing; and a second rectangular shutter housing slidably received within the first rectangular shutter housing, wherein the first rectangular shutter housing and the second rectangular shutter housing collectively define an air inlet through which air is delivered to the gas burner via the clean air port.

10. The oven appliance of claim 9, wherein the air inlet is positioned below the clean air port along the vertical direction.

11. The oven appliance of claim 9, wherein the second rectangular shutter housing is configured to slide in the transverse direction axially along the gas burner.

12. The oven appliance of claim 9, wherein the rectangular shutter housing defines an air inlet, the air inlet being defined below the gas burner in the vertical direction.

13. The oven appliance of claim 12, wherein the air inlet faces a bottom of the cooking chamber.

14. The oven appliance of claim 9, further comprising a tray extending from the second rectangular shutter housing in the transverse direction, the tray defining a through hole therein, wherein the gas burner is configured to contact the tray.

15. The oven appliance of claim 9, wherein the second rectangular shutter housing defines a mounting hole configured to receive the first end of the gas burner.

16. The oven appliance of claim 9, wherein the gas burner is a broil burner mounted at a top of the cooking chamber.

* * * * *